US005395280A

United States Patent [19]

Greenberg

[11] Patent Number: 5,395,280

[45] Date of Patent: Mar. 7, 1995

[54] SURGICAL BRASSIERE HAVING OVERLAPPING FRONT AND SIDE PROSTHESIS RECEIVING POCKETS

[76] Inventor: Bert Greenberg, 2030 S. Ocean Dr., Hallandale, Fla. 33009

[21] Appl. No.: 116,284

[22] Filed: Sep. 3, 1993

[51] Int. Cl.[6] ..... A41C 3/10; A41C 3/14

[52] U.S. Cl. ..... 450/54; 450/32; 450/55; 450/57; 2/267; 2/247

[58] Field of Search ..... 2/67, 73, 247, 248, 2/249, 250, 251, 252, 22, 23, 24, 267, 268, 104; 450/30, 31, 32, 53, 54, 55, 56, 57, 89, 150

[56] References Cited

U.S. PATENT DOCUMENTS 862,376 8/1907 Bachman ..... 450/57

3,521,642 7/1970 Jordan ..... 450/57 X 3,568,681 3/1971 Comollo ..... 450/57 X 5,180,326 1/1993 Williams ..... 450/91

*Primary Examiner*—Jeanette E. Chapman

*Attorney, Agent, or Firm*—McAulay Fisher Nissen Goldberg & Kiel

[57] ABSTRACT

A surgical brassier is disclosed having a first pocket with an opening for receiving a front breast prosthesis and a second pocket with an opening for receiving a side prosthesis. The second pocket is disposed in overlapping relation to the first pocket such that any tab on the front prosthesis in the first pocket which extends out of the first pocket opening will be covered by the second pocket to prevent contact of the prosthesis tab with the skin of the wearer.

1 Claim, 1 Drawing Sheet

SURGICAL BRASSIERE HAVING OVERLAPPING FRONT AND SIDE PROSTHESIS RECEIVING POCKETS

BACKGROUND OF THE INVENTION

I. Field of the Invention

This invention relates generally to surgical brassieres and, more specifically, to a surgical brassiere having overlapping front and side pockets disposed to respectively receive a front breast prosthesis and a side prosthesis.

II. Description of the Prior Art

Heretofore, it is known to construct a surgical brassiere having non-overlapping front and side pockets disposed to respectively receive a front breast prosthesis and a side prosthesis. Brassieres of such construction are worn by women who have undergone a mastectomy to remove malignant breast tissue. In extreme instances, it becomes necessary to surgically remove not only the affected breast but underarm tissue as well leaving a depression on the side of the patient in the region under the arm. A side prosthesis, separate from the front breast prosthesis, is received in the side pocket of the brassiere to fill the depression in the patient's side when the brassiere is worn to improve comfort to the wearer.

The front breast prosthesis typically is formed of an elastic synthetic polymer having a central zone representative of a woman's breast and a peripheral zone terminating in a tab portion. The shape and size of the front pocket is configured to permit the prosthesis tab portion to extend out of the pocket opening to facilitate handling for insertion and removal of the prosthesis from the associated pocket.

The front and side pockets are formed on the inner surface of the brassiere which comes in contact with the wearer's skin. In the heretofore known brassiere constructions, the front and side pockets are spaced apart without any portions thereof coming in contact with one another. This results in the outwardly extending tab portion of the front breast prosthesis coming in contact with the skin of the wearer to cause possible irritation and discomfort.

The side prosthesis, while formed of a similar material, is considerably smaller than the front breast prosthesis and is easier to handle. As such, the side prosthesis is received entirely within the side pocket of the brassiere and does not come in contact with the wearer's skin when the brassiere is worn.

The present invention improves on the heretofore known surgical brassiere constructions by configuring the front and side pockets of the brassiere in a manner hereinafter described thereby to prevent contact between the tab portion of the front breast prosthesis and the wearer's skin.

SUMMARY OF THE INVENTION

The surgical brassiere of the present invention is constructed having a first pocket for receiving a front breast prosthesis and a second pocket for receiving a side prosthesis. The first pocket has an outboard facing side opening to permit insertion and removal of the front prosthesis and the second pocket has an inboard facing side opening to permit insertion and removal of the side prosthesis. The second pocket is disposed in overlapping relation to the first pocket such that the pocket opening of the second pocket is inboard of the pocket opening of the first pocket. The arrangement is such that any tab on the front prosthesis which extends out of the pocket opening of the first pocket will be covered by the second pocket to prevent contact of the prosthesis tab with the skin of the wearer.

DESCRIPTION OF THE PREFERRED EMBODIMENT

Figure 1:
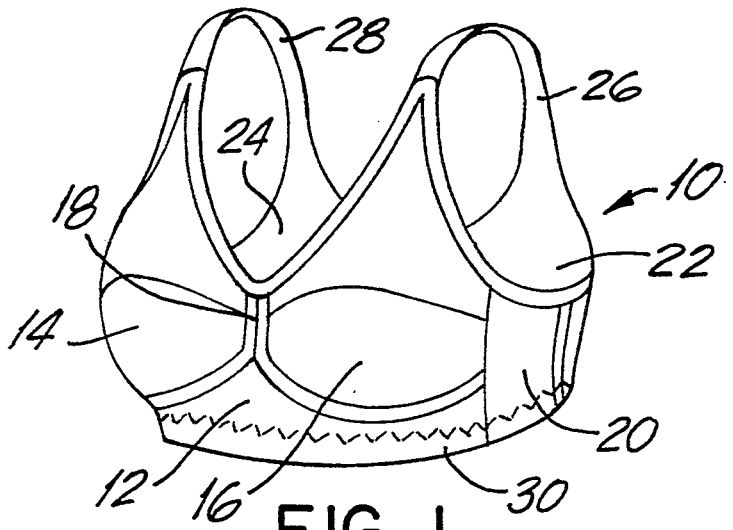
FIG. 1 is a perspective view of a surgical brassiere constructed in accordance with the present invention.

Referring to the drawings, numeral 10 represents a surgical brassiere constructed in accordance with the present invention. Brassiere 10 includes a front panel 12 joined to spaced-apart breast cup panels 14 and 16. The breast cup panels 14 and 16 are joined together along a vertical centerline of the brassiere represented by numeral 18. A side panel 20 is joined to breast cup panel 16 and extends outboard therefrom to cover a side portion of the wearer in the region under the arm. A similar side panel (not shown) is joined to breast cup panel 14 and extends outboard therefrom to cover the opposite underarm side portion of the wearer. The side panels are respectively joined to elastic back panels 22 and 24 which merge upwardly to form elastic shoulder straps 26 and 28. The shoulder straps join the back panels to the breast cup panels. A lower, body-encircling band 30 is joined to the lower edges of front panel 12, breast cup panels 14 and 16, side panels 20, and back panels 22 and 24. A band 32 is joined to back panel 22 and a similar band (not shown) is joined to back panel 24. The bands 32 are provided with interengaging fastening elements, represented generally by numeral 34, in the region adjacent the wearer's back, for assembling brassiere 10 to the wearer's body in conventional manner.

Figure 2:
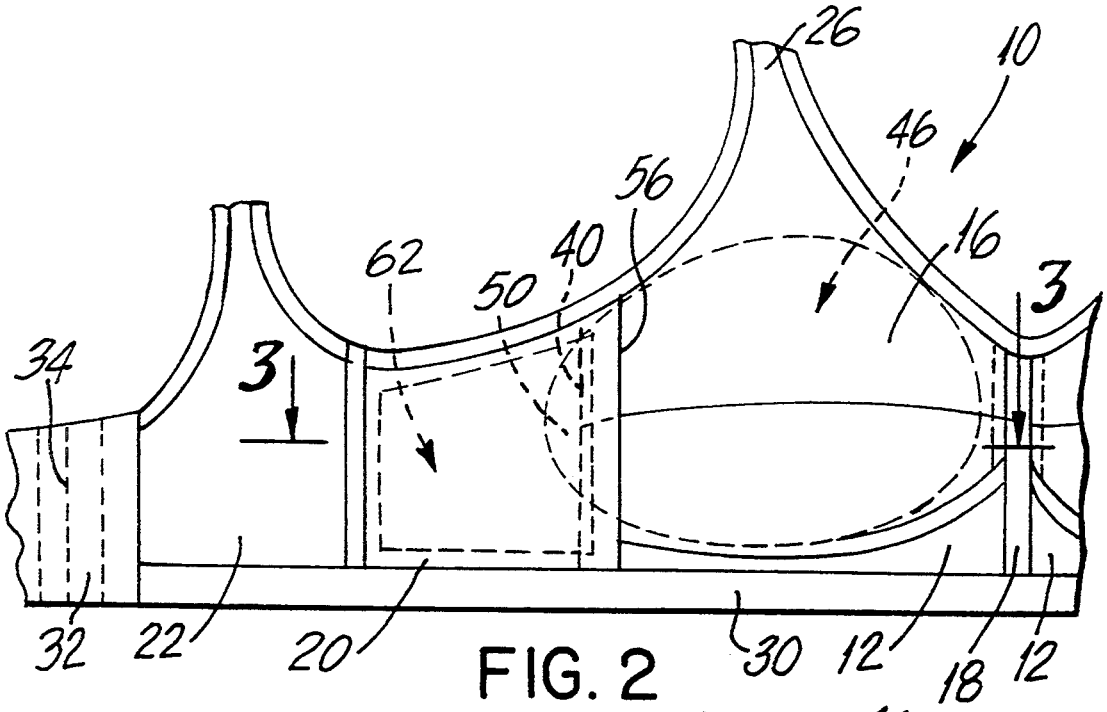
FIG. 2 is a side elevational view of an inner surface portion of the brassier showing a front breast pocket and a side pocket each containing the appropriate prosthesis, with the front and side pockets disposed in overlapping relation.
Figure 3:
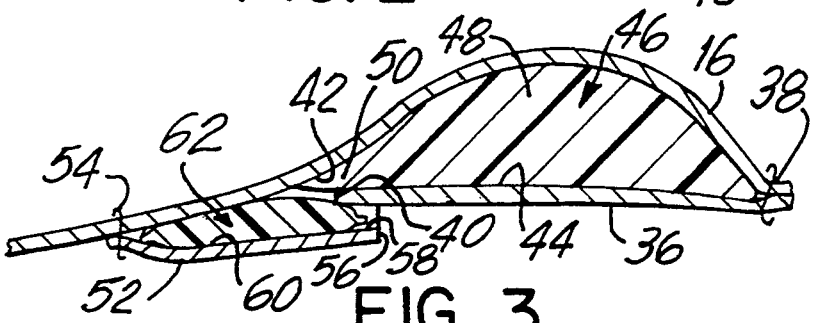
FIG. 3 is a sectional view taken along line 3—3 of FIG. 2.

As shown in FIGS. 2 and 3, a lining 36 is secured to the inner surface of breast cup panel 16 by suitable stitching represented by numeral 38. The side edge 40 of lining 36 outboard from centerline 18 is free of breast panel 16 to define an opening 42. The space between lining 36 and breast panel 16 defines a pocket 44 accessible through opening 42 for receiving a front breast prosthesis 46. The prosthesis 46 is formed of an elastic synthetic polymer having a central zone 48 representative of a woman's breast, and a peripheral zone terminating in tab portion 50. As previously noted, tab portion 50 is provided to facilitate handling of the prosthesis. When prosthesis 46 is inserted in pocket 44, tab portion 50 extends out of or beyond pocket opening 42.

A lining 52 is secured to the inner surface of side panel 20 by suitable stitching represented by numeral 54. The side edge 56 of lining 52 inboard of centerline 18 is free of side panel 20 to define an opening 58. The space between lining 52 and side panel 20 defines a pocket 60 accessible through opening 58 for receiving a side prosthesis 62. The prosthesis 62, which is constructed of a similar material as prosthesis 46, is configured to be received entirely within pocket 60.

In accordance with the invention, a portion of pocket 60 overlies a portion of front pocket 44. That is, the side edge 56 of lining 52 overlies the side edge 40 of lining 36 to locate side pocket opening 58 inboard of front pocket opening 42. In such construction, the tab portion 50 of front prosthesis 46 which extends out of pocket opening 42 is covered by the lining 52 of side pocket 60 thereby to prevent the prosthesis tab portion 50 from coming into contact with the wearer's skin when the brassiere is worn.

While the preferred embodiment shows lining 52 overlapping lining 36, it is within the scope of the invention to reverse the overlapping configuration of the linings so that side edge 40 may overlie side edge 56. In such event, front pocket opening 42 would overlie side pocket opening 58. The net result would be the same since the side 56 of lining 52 would still cover prosthesis tab portion 50 to prevent contact of said tab portion with the wearer's skin.

Although the description refers to only one of the two breast cup panels and its adjoining side panel, it will be appreciated that the other breast cup panel and its adjoining side panel would be similarly constructed to accommodate the appropriate prosthesis, if needed by the wearer.

While a preferred embodiment of the invention has been shown and described in detail, it will be further appreciated and understood that numerous omissions, changes and additions may be made without departing from the spirit and scope of the invention,

What is claimed is:

1. In a surgical brassiere in combination with a front breast prosthesis and a separate side prosthesis, said brassiere having a front pocket with an outboard facing opening, a side pocket having an inboard facing opening, a front breast prosthesis having a tab portion received in said front pocket with said tab portion extending out of the pocket opening thereof, and said separate side prosthesis received in said side pocket, the said combination further comprising:

said side pocket overlapping said front pocket so that the opening of said side pocket is inboard of the opening of said front pocket, whereby said outwardly extending tab portion of said front prosthesis is covered by said side pocket to prevent contact of said prosthesis tab portion with the skin of the wearer.

* * * * *